United States Patent [19]

Oelsch et al.

[11] 4,020,444

[45] Apr. 26, 1977

[54] SLIDER ARRANGEMENT FOR POTENTIOMETERS OR THE LIKE

[75] Inventors: Kurt Oelsch; Klaus Schulz, both of Berlin, Germany

[73] Assignee: Fernsteuergerate, Kurt Oelsch KG, Berlin-Britz, Germany

[22] Filed: Feb. 6, 1976

[21] Appl. No.: 655,730

[30] Foreign Application Priority Data

Feb. 27, 1975 Germany ..... 2508530

[52] U.S. Cl. ..... 338/202; 200/276; 338/167

[51] Int. Cl.[2] ..... H01C 1/12

[58] Field of Search ..... 338/212, 154, 160, 167, 338/169, 170; 200/276; 113/119

[56] References Cited

UNITED STATES PATENTS

| | | | |
|---|---|---|---|
| 2,798,137 | 7/1957 | Rasmussen | 338/171 X |
| 3,497,856 | 2/1970 | Scheel | 338/162 |

*Primary Examiner*—C. L. Albritton
*Attorney, Agent, or Firm*—Darbo, Robertson & Vandenburgh

[57] ABSTRACT

A slider arrangement for potentiometers is presented, which provides good contact between the potentiometer resistor and the slider with low friction and low wear. With each position of slider guide means, the slider contacts the potentiometer resistor in an associated well defined point regardless of the direction of movement of the guide means. To this end the slider comprises a wire helix in crossed relation to the potentiometer resistor. The wire helix is urged into engagement with the potentiometer resistor by a strap extending into the wire helix and engaging the inner side thereof under spring tension, whereby engagement between helix and strap and the required contact pressure between helix and potentiometer resistor is established. The strap has bays or recesses in the area of the potentiometer resistor to permit the turns of the wire helix to conform to the cross sectional contour of the resistor. In one embodiment the strap and the wire helix extend across both the potentiometer resistor and an adjacent sliding contact means.

9 Claims, 10 Drawing Figures

SLIDER ARRANGEMENT FOR POTENTIOMETERS OR THE LIKE

GENERAL BACKGROUND AND SUMMARY OF THE INVENTION

The invention relates to a slider for potentiometers or the like in the form of a wire helix, the axis of the wire helix extending transversely to the direction of displacement of the slider.

Such sliders offer the advantage that they can be moved along the potentiometer resistor with low friction and wear, ensure firm contact and are able to conform to the cross sectional contour of the potentiometer resistor.

A potentiometer slider in the form of a wire helix is known which is extended around by a u-shaped guide member and is guided thereby along the potentiometer resistor. With this prior art potentiometer slider an undesirable hysteresis is experienced due to inevitable tolerances of the wire helix and the guide member, i.e. the point of contact of the wire helix on the potentiometer resistor, associated with a certain position of the guide member, depends on the direction of movement of the slider.

It is the object of the invention to design a slider of the type defined in the beginning in which the wire helix is guided without hysteresis.

In accordance with the invention this object is achieved in that the helix is guided by a strap which loosely extends into the helix and engages the inner side of the helix under the action of spring tension generating the contact pressure. The strap engages the inner side of the helix under the action of the contact pressure and guides it without hysteresis, no particularly close tolerances being required. Furthermore, it is possible that the strap has a contour permitting the helix to conform to the cross sectional contour of the potentiometer resistor or the like. The strap can be flexibly resilient to generate the contact pressure. However the strap may also be affixed to an initially tensioned spring to generate the contact pressure. Using a yielding spring, in which a relative large spring deflection is required to generate the initial tension—as compared to the possible movements of the slider in the direction of the force—avoids the necessity of readjustment of the initial tension. One possible design consists in that the spring is a leaf spring having substantially trapezoidal shape which is supported along the base side and has a lug forming said strap at its free end damping of oscillations can be achieved in that the leaf spring is supported together with a second, substantially trapezoidal, frame-shaped leaf spring, which surrounds the former leaf spring and which is engaged by the free end of said lug or strap projecting from the helix. The strap may consist of a material of high electric conductivity, so that it shunts electrically the individual turns of the wire coil.

The surface of the strap may be coated for better contact making, the helix being electrically connected to an output terminal through a spring connected to the strap. The invention is explained in greater detail with reference to some embodiments and to the associated drawings:

DESCRIPTION OF SPECIFIC EMBODIMENTS

Figure 1:
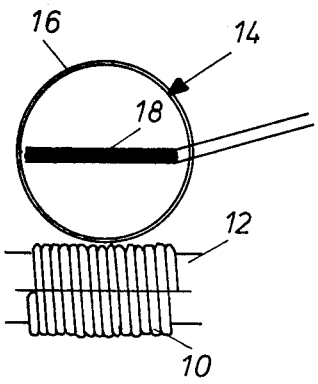
FIG. 1 illustrates a slider designed in accordance with the invention together with a potentiometer winding.
Figure 2:
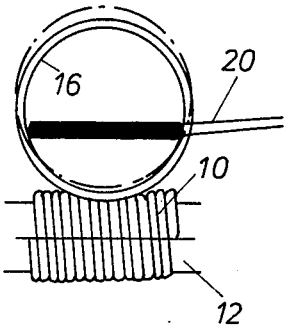
FIG. 2 illustrates the slider of FIG. 1 when it is pressed against the potentiometer winding.
Figure 3:
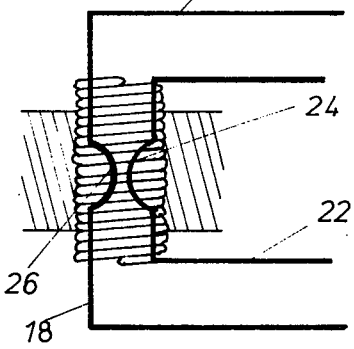
FIG. 3 is a plan view of a slider arrangement of FIG. 2.

In the embodiment of FIGS. 1 to 4, numeral 10 designates a cylindrical wire helix of a potentiometer resistor, which is wound on a core 12. A slider 14 comprises a wire helix 16 the axis of which is crossed to the axis of the wire helix 10. A strap 18 is located in the wire helix, which, as can be seen from FIG. 1, may well have certain slackness with respect to the diameter of the wire coil. The strap 18 is located between two leaf springs 20, 22 or is made as an integral spring sheet metal element therewith. The leaf springs are pretensiond so that the slider with wire helix engages the wire helix 10 of the potentiometer resistor with the contact pressure required. The leaf springs are relatively yielding so that a correspondingly large spring deflection is required to generate the contact pressure exerted, this deflection being large as compared to the movements, if any, of the slider in vertical direction in FIG. 1. Thereby readjustment of the contact pressure becomes unnecessary.

Under the action of the contact pressure exerted through leaf springs 20, 22 and strap 18, the strap tightly engages the inner side of the wire helix 16. Thereby the wire helix is held free from play so that no hysteresis will occur, when the wire helix is guided by the strap 18 towards one or the other direction along the potentiometer resistor.

Figure 4:
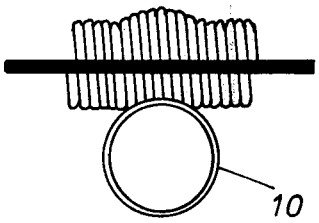
FIG. 4 is an elevational view from the left side in FIG. 3.

The wire helix 10 of the potentiometer resistor has a cylindrical surface. The wire helix 16 of the slider should be able to conform thereto. To this end the strap has opposed bays 24 and 26 in the area of the potentiometer resistor, as can be seen from FIG. 3. These bays permit resilient lateral displacement, in accordance with the cross sectional contour of the potentiometer resistor, of those turns of wire helix 16 which engage the potentiometer resistor, as shown in FIG. 4. Adjacent these bays there is a well defined guidance of the wire coil 16 by the strap 18.

Figure 5:
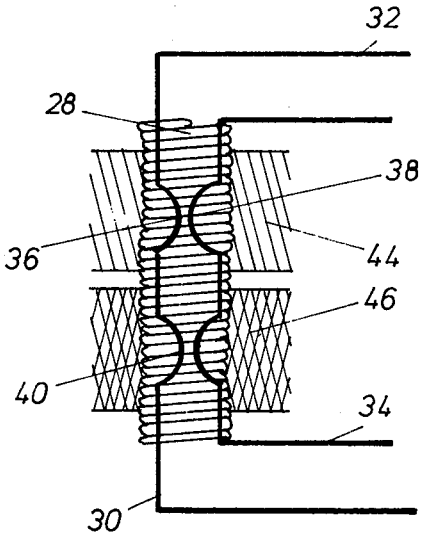
FIG. 5 illustrates another embodiment of the invention.
Figure 6:
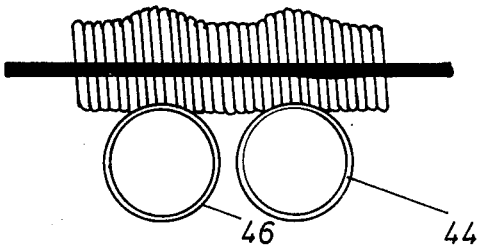
FIG. 6 is an elevational view from the left side in FIG. 5.

In the embodiment of FIGS. 5 and 6 an elongated slider wire helix 28 is mounted on a strap 30. This strap 30 is the central portion of a u-shaped spring sheet metal element, the two legs of which form two leaf springs 32, 34 for generating the contact pressure. The strap 30 has two pairs of opposed bays 36, 38 and 40, 42. These bays are in the areas of a potentiometer resistor 44 and a sliding contact 46, respectively, which extend in parallel with each other. It is also possible that the potentiometer resistor 44 is wound torically and the sliding contact 46 is a slip ring concentric with the potentiometer resistor. The wire helix 28 of the slider connects one point on the potentiometer resistor 44 to the sliding contact 46. Again the bays 36, 38 and 40, 42, respectively, permit resilient lateral displacement of those turns of the wire helix, which engage the potentiometer resistor, to conform with the contours of the potentiometer resistor 44 and the slider contact 46.

Figure 8:
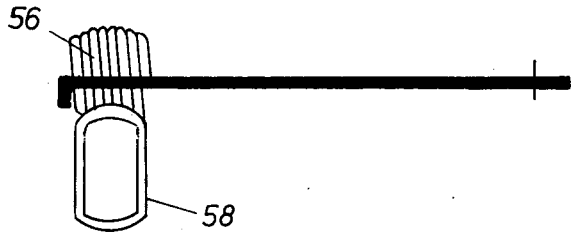
FIG. 8 is an elevational view from the left side in FIG. 7.
Figure 7:
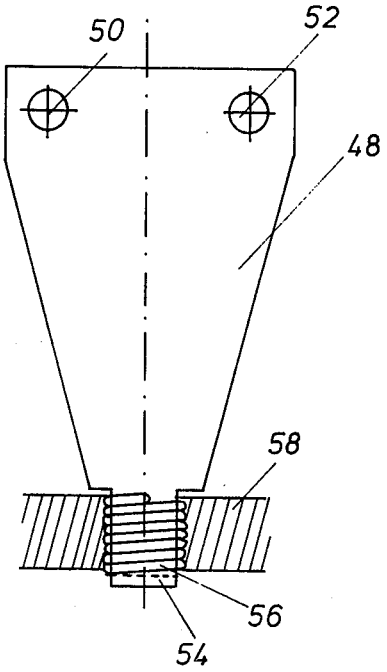
FIG. 7 is a plan view of a further embodiment of the invention.

In the embodiment of FIGS. 7 and 8 the leaf spring 48 has substantially trapezoidal shape. It is affixed by means of screws 50, 52 along its base side, and has a lug 54 at its free end, which lug extends as a strap into the interior of a wire helix. The wire helix 56 engages a potentiometer resistor 58.

Figure 10:
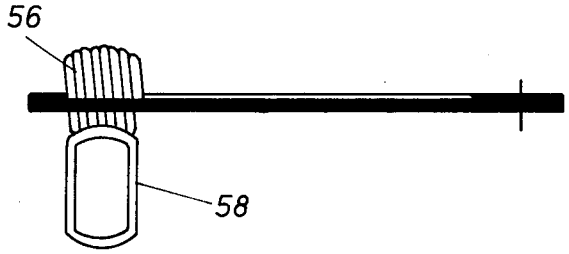
FIG. 10 is an elevational view from the left side in FIG. 9.
Figure 9:
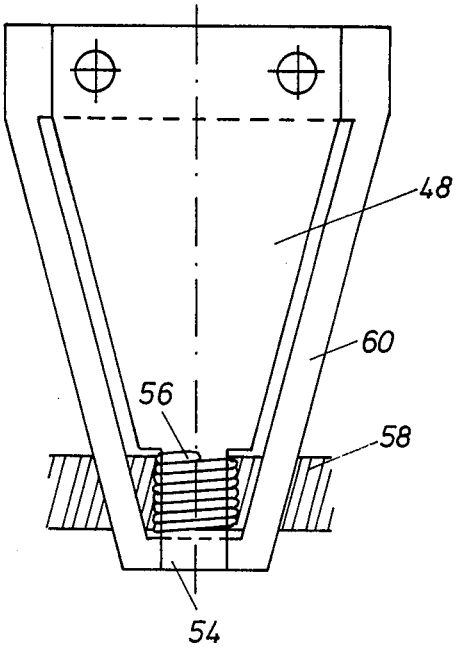
FIG. 9 is a plan view of a modified embodiment similar to FIG. 7.

The embodiment of FIGS. 9 and 10 is similar to that of FIGS. 7 and 8, and corresponding elements bear the same reference numerals as there. The triangular leaf spring 48, in plan view, is surrounded by a frame-like leaf spring 60 also having substantially trapezoidal shape, and the free end of the lug 54 engages this leaf spring 60. With a deflection of the leaf springs 48 and 60 the end of lug 54 causes friction on the leaf spring 60. Also these two leaf springs 48, 60 have different natural frequencies. This acts to damp vibrations.

The strap 18, 30 and 54 consists of a material having high electric conductivity, whereby the individual turns of the wire helix 16 or 28 or 56, respectively, are shunted.

The wire helix may slide on a coil 10 of the potentiometer resistor alone as shown in FIGS. 1 to 4, and transmit the contact through the leaf springs, which then have to be formed by coated bronze springs. The wire helix 28 may, however, also establish a direct connection between the potentiometer resistor 44 and the slider contact 46, in which case the leaf springs 32, 34 then need not to be coated.

What is claimed is:

1. In a slider arrangement comprising: electrically conducting means, slider means in the form of a wire helix having an inner side, guiding means for moving said slider means along said electrically conducting means, and contact pressure generating means for urging said slider means into engagement with said electrically conducting means under a contact pressure, the improvement wherein said guiding means comprises a strap, which loosely extends into said wire helix, said contact pressure generating means urging said strap into tight engagement with said inner side of the wire helix under said contact pressure, which is transmitted to said wire helix through said strap.

2. A slider arrangement as set forth in claim 1 wherein said electrically conducting means is a potentiometer resistor.

3. A slider arrangement as set forth in claim 1, wherein said electrically conducting means has a rounded cross sectional contour, said slider means wire helix being arranged in crossed relation to said electrically conducting means, and wherein said strap has a contour permitting said slider means wire helix to conform to the cross sectional contour of said electrically conducting means.

4. A slider arrangement as set forth in claim 3, wherein said electrically conducting means is a potentiometer resistor comprising a second wire helix.

5. A slider arrangement as set forth in claim 1, wherein said contact pressure generating means comprises a tensioned spring, said strap being affixed to said spring.

6. A slider arrangement as set forth in claim 5, wherein said spring is a leaf spring having substantially trapezoidal shape with a long base side and a short side parallel thereto and a pair of oblique sides interconnecting the ends of said base and short sides, said slider arrangement further comprising supporting means for supporting said first leaf spring along said long base side, and wherein said strap is a lug formed at the free end of said leaf spring.

7. A slider arrangement as set forth in claim 5 and further comprising a second leaf spring having the shape of a substantially trapezoidal frame, which includes a long base portion and a short end portion parallel thereto and a pair of oblique side portions interconnecting said base and end portions; said strap having an end projecting from said wire helix, said second leaf spring being also supported by said supporting means along said base portion, each of said side portions extending adjacent a respective one of said oblique sides of said trapezoidal leaf spring and engaging said projecting end of said strap, whereby vibrations of said trapezoidal leaf spring and said strap are damped.

8. A slider arrangement as set forth in claim 3, wherein said strap consists of high conductivity material, the surface of the strap being coated for better contact making, and further comprising an output terminal and means for electrically connecting said strap to said output terminal.

9. A potentiometer having an adjustable slider arrangement comprising:

a potentiometer resistor comprising a core body of substantially circular cross section and a wire helix having a first end and a second end wound thereon, said first and second ends being for connection to first and second terminals, respectively;

a sliding contact means extending adjacent but spaced from said potentiometer resistor for connection to a third terminal;

a strap of elastic sheet metal comprising a straight central portion and a pair of legs extending at right angles to said central portion from the ends thereof and having ends remote from said central portion, said central portion extending across said potentiometer resistor and said sliding contact means and having pairs of opposed bays in the areas of said potentiometer resistor and of said sliding contact means, a wire helix mounted on said central portion and extending over both said potentiometer resistor and said sliding contact means, said legs being biased to urge said wire helix into contact with both said resistor and said sliding contact means.

* * * * *